United States Patent [19]

Haruta et al.

[11] Patent Number: 4,711,830

[45] Date of Patent: Dec. 8, 1987

[54] IMAGE RECORDING MATERIAL COMPRISING PHOTOSENSITIVE LAYER AND RECORDING LAYER ON ELECTROCONDUCTIVE BASE

[75] Inventors: Masahiro Haruta; Yoko Kuwae, both of Tokyo; Satoshi Yuasa, Yokohama; Toshihiko Miyazaki, Tokyo, all of Japan

[73] Assignee: Canon Kabushiki Kaisha, Tokyo, Japan

[21] Appl. No.: 820,800

[22] Filed: Jan. 22, 1986

[30] Foreign Application Priority Data

Jan. 24, 1985 [JP] Japan ..... 60-9843
Jan. 24, 1985 [JP] Japan ..... 60-9844

[51] Int. Cl.[4] ..... G03C 1/54; G03C 1/71; G03C 1/733

[52] U.S. Cl. ..... 430/52; 430/147; 430/175; 430/271; 430/281; 430/296; 430/348; 430/945; 430/519; 430/563; 430/56

[58] Field of Search ..... 430/52, 56, 413, 414, 430/270, 269

[56] References Cited

U.S. PATENT DOCUMENTS 4,082,551 4/1978 Steklenski et al. ..... 430/64

*Primary Examiner*—J. David Welsh
*Attorney, Agent, or Firm*—Fitzpatrick, Cella, Harper & Scinto

[57] ABSTRACT

An image recording material is provided which comprises an electroconductive base plate, a recording layer provided on at least one side of said plate and a photosensitive layer provided on said recording layer. The recording layer may constituted of a electrolytically polymerized film, and the photosensitive layer may constituted of a polymer complex formed from a basic polymer and an acidic polymer. A method for image recording is also provided.

19 Claims, 5 Drawing Figures

IMAGE RECORDING MATERIAL COMPRISING PHOTOSENSITIVE LAYER AND RECORDING LAYER ON ELECTROCONDUCTIVE BASE

BACKGROUND OF THE INVENTION

1. Field of the Invention

The present invention relates to an image recording material which is useful for recording a desired information using a pattern of actinic rays and converting the recorded information to a visible image. More particularly, the present invention relates to an image recording material comprising an electroconductive base plate, a recording layer of particular constitution provided on said base plate and a photosensitive layer of particular constitution provided on said recording layer, wherein a desired information can be recorded in the photosensitive layer in a form of a latent image by using a pattern of actinic rays and then the latent image can easily be converted to a visible image formed in the recording layer by subjecting the recording layer to electrochemical development.

2. Description of the Related Art

A number of methods are known for recording information using an actinic ray pattern or a thermal pattern. These methods use an image recording material comprising a base plate and a photosensitive or heat-sensitive layer provided on the base plate, whose physical, chemical, electrical or magnetic properties are changed by an actinic ray pattern or by a thermal pattern. When the pattern is applied to the photosensitive or heat-sensitive layer, a visible change appears or a recorded image which can be read out by an appropriate reading-out means which is formed in the photosensitive or heat-sensitive layer. The photosensitive layer is formed from a photosensitive material in many cases and the material includes polymers, coloring substances and their mixtures.

Thus, the photosensitive layer of the image recording material in the conventional recording methods utilizing a pattern of actinic rays generally employs a photosensitive polymer or a photosensitive coloring substance. Therefore, in forming a photosensitive layer from such a raw material, the material must be handled with thorough care.

In more detail, when a photosensitive layer is formed from a material sensitive to light such as visible light or ultraviolet rays, sufficient care must be taken to protect the material before use from exposure to light. For the same reason, greater care must be taken in storage of an image recording material comprising said photosensitive layer. Otherwise, the recording material loses its photosensitivity before use and becomes useless.

Even if such care is taken, conventional image recording materials utilizing a pattern of actinic rays are insufficient in storage stability after recording and have no satisfactory reliability for long storage.

Under such circumstances, a high demand still exists for an image recording material whose photosensitive layer can easily be formed without paying any special care and wherein information can easily be recorded and the recorded information can be stored stably over a long period of time, as well as for a recording method using such an image recording material.

SUMMARY OF THE INVENTION

The present inventors made extensive research in order to meet the above demand and completed the present invention. Desired information can be easily be recorded with actinic rays by employing electroconductive base plate as a supporting substrate for image recording material, by forming a recording layer from a specific material, and by employing a polymeric material of a specific constitution. Further, recorded images can be obtained with satisfactory storage stability by employing electrochemical means to obtain visible image from a latent image of the recorded information.

According to an aspect of the present invention, there is provided an image recording material comprising a recording layer and a photosensitive layer, both layers being provided on an electroconductive base plate.

According to another aspect of the present invention, there is provided an image recording material comprising a recording layer comprised of an electrolytically polymerized colored film and a photosensitive layer, both layers being provided on an electroconductive base material.

According to still another aspect of the present invention, there is provided an image recording material comprising a recording layer comprised of an electrolytically polymerized colored film and a photosensitive layer comprised of a polymer complex, both layers being provided on an electroconductive substrate.

According to a further aspect of the present invention, there is provided an image recording material comprising a recording layer comprised of an electrolytically polymerized colored film and a photosensitive layer comprised of a polymer complex formed from a basic polymer and an acidic polymer, both layers being provided on an electroconductive substrate.

According to a still further aspect of the present invention, there is provided a method for image recording, comprising applying light or heat, corresponding to information to be recorded, on an image recording material comprised of a recording layer and a photosensitive layer provided on an electroconductive base plate and then developing the recording material electrochemically.

DETAILED DESCRIPTION OF THE PREFERRED EMBODIMENTS

Figure 1:
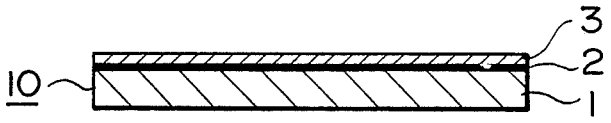
FIGS. 1 and 2 each illustrate the structure of an image recording material of the present invention.

The primary feature of the present invention is use of an electroconductive base plate as the substrate of image recording material. The second feature is the recording layer constituted of a particular colored polymer. The third feature is employment of a particular polymer complex for formation of the photosensitive layer.

The image recording material of the present invention having such a constitution, when exposed to a pattern of actinic rays in accordance with an ordinary method, forms a latent image, which is then converted easily to a visible image by subjecting the recording material to electrochemical development.

The following description will focus on the above features.

The electroconductive base plate used as the substrate of the image recording material of the present invention can be any electroconductive material. There can be used, for example, a metal plate of gold, platinum, silver, nickel or copper, or a plate obtained by vapor-depositing on a desired substrate such as a glass plate, a plastic film or a plastic sheet, said metal, tin oxide, indium oxide, indium-tin oxide or any other electroconductive material.

In the present invention, the recording layer provided on at least one side of the base plate is formed in accordance with electrolytic polymerization. This electrolytic polymerization is conducted by polymerizing an electrolytically polymerizable monomer added to an electrolytic solution, using an electroconductive base plate as an anode.

The electrolytic polymerization method used in the present invention is known in, for example, "Oyobutsuri (Applied Physics), Vol 52, No. 11, pages 971 to 974, 1983". In-depth research by the present inventor revealed that the electrolytically polymerized film obtained by the polymerization method is suitable for use as a recording layer of the image recording material of the present invention.

When an electric current is allowed to flow through an electrolytic solution containing an electrolytically polymerizable monomer, using the above mentioned electroconductive base plate as an anode, electrolytic polymerization takes place on the surface of the anode and a colored, electrolytically polymerized film is formed on the surface. This film can function as an excellent recording layer.

As the electrolytically polymerizable monomer, there can be mentioned, for example, pyrrole, thiophene, furan, selenophene, tellurophene, indole, azulene, aniline, thienothiophene, pyrrolopyrrole and diacetylene. It is preferable that these monomers be used in an electrolytic solution in the concentration of about 0.001 to 1 M.

The cathode as a counter electrode of the anode can be any electrode material such as gold, platinum, nickel or the like. The cathode can have any shape.

The electrolytic solution can be any conventionally known electrolytic solution such as water, acetonitrile, ethanol, dimethylformamide, dioxane, dichloroethane, tetrahydrofuran or the like. The electrolytic solution can contain, as necessary, any electrolyte such as KCl, NaBr, KI, $LiClO_4$, $LiBF_4$, tetra-n-butylammonium perchlorate, tetra-n-butylammonium perfluoroborate, tetramethylammonium chloride, $Na_2SO_4$ or the like. The concentration of electrolyte in electrolytic solution is preferably about 0.01 to 1 M.

The conditions for electrolytic polymerization depend on the type of monomer, the type and shape of electrode, the types and concentrations of electrolytic solution and electrolyte, the size of recording surface of the electroconductive base plate used in the present invention, etc. Generally, by applying a DC voltage of 1 to 10 V, an electrolytically polymerized colored film, namely, a recording layer having a thickness of about 0.1 to 10 μm is formed on the electroconductive base plate in several seconds to several minutes.

The electrolytically polymerized film formed as above have, in general, has a dark brown to dark black color depending upon the type of electrolyte used. When the color is light, the hue or density of the color can be changed or increased by dissolving in the electrolytic solution an appropriate amount of a coloring substance such as a dye having anionic groups (e.g. an acidic dye, a direct cotton dye). As a matter of course, such coloring by a dye or the like can also be conducted after film formation.

The polymer complex used for forming a photosensitive layer on the recording layer provided on the base plate comprised of a basic polymer and an acidic polymer and is known in, for example, Japanese Patent Publication No. 42744/1980. The basic polymer includes, for example, the following compounds.

Homopolymers of N-vinylpyrrolidone, N-vinyl-3-methylpyrrolidone, N-vinyl-5-methylpyrrolidone, N-vinyl-3,3,5-trimethylpyrrolidone, N-vinyl-3-benzylpyrrolidone, N-vinylpiperidone, N-vinyl-4-methylpiperidone, N-vinylcaprolactam, N-vinylcapryllactam, N-vinyl-3-morpholine, N-vinylthiopyrrolidone, N-vinyl-2-pyridone, etc.; random or block copolymers prepared from one of said monomers and other ordinary monomer; and graft copolymers obtained by graft-polymerizing one of said monomers with other ordinary monomer.

Homopolymers of N-vinyl-2-oxazolidone, N-vinyl-5-methyl-2-oxazolidone, N-vinyl-5-ethyl-2-oxazolidone, N-vinyl-4-methyl-2-oxazolidone, N-vinyl-2-thiooxazolidone, N-vinyl-2-mercaptobenzothiazole, etc.; random or block copolymers prepared from one of said monomers and other ordinary monomer; and graft copolymers obtained by graft-polymerizing one of said monomers with other ordinary monomer.

Homopolymers of N-vinylimidazole, N-vinyl-2-methylimidazole, N-vinyl-4-methylimidazole, etc.; random or block copolymers prepared from one of said monomers and other ordinary monomer; and graft copolymers obtained by graft-polymerizing one of said monomers with other ordinary monomer.

Homopolymers of 2-vinylpyridine, 4-vinylpyridine, etc; random or block copolymers between one of said monomers and other ordinary monomer; and graft copolymers obtained by graft-polymerizing one of said monomers with other ordinary monomer.

The other ordinary monomer mentioned above includes a methacrylate, an acrylate, acrylic amide, acrylonitrile, vinyl ether, vinyl acetate, vinyl imidazole, ethylene, styrene, and other ordinary monomers. Particularly useful as the basic polymer in the present invention are homopolymers and copolymers of N-vinylpyrrolidone, N-vinylpiperidone, N-vinylcaprolactam, N-vinylmorpholine, N-vinyl-2-oxazolidone and N-vinyl-5-methyl-2-oxazolidone. When a copolymer is used as the basic polymer, it is preferable that the copolymer contains a nitrogen-containing monomer such as mentioned above in an amount of 50 mole % or more.

The acidic polymer which can form a polymer complex with a basic polymer as mentioned above includes the following compounds.

Polyesters having a terminal carboxyl group, obtained by reacting a polycarboxylic acid such as citric acid, tartaric acid, phthalic acid or the like with a polyhydric alcohol such as ethylene glycol, 1,4-butanediol, diethylene glycol or the like with an acid in excess.

Acidic cellulose derivatives obtained by modifying cellulose with a polycarboxylic acid. (Reference is made to Japanese Patent Publication No. 5093/1960); homopolymers of a vinyl ether ester of a polycarboxylic acid, etc; random or block copolymers between said monomer and other ordinary monomer; and graft copolymers obtained by graft-polymerizing said monomer with other ordinary monomer. (Reference is made to Japanese Patent Publication No. 8495/1960).

Homopolymers of acrylic acid, methacrylic acid, etc.; random or block copolymers prepared from one of said monomers and other ordinary monomer; and graft copolymers obtained by graft-polymerizing one of said monomers with other ordinary monomer.

Homopolymers of an $\alpha$, $\beta$-unsaturated vinyl monomer (e.g. maleic anhydride, itaconic acid), etc; random or block copolymers prepared from said monomer and other ordinary monomer; graft copolymers obtained by graft-polymerizing said monomer with other ordinary monomer.

Homopolymers of a monomer having a sulfonic group or a phenolic hydroxyl group; random or block copolymers prepared from said monomer and other ordinary monomer; and graft copolymers obtained by graft-polymerizing said monomer with other ordinary monomer.

Acidic polymers obtained by modifying a polymer with a compound having a carboxyl group, a sulfonic group or a phenolic hydroxyl group.

Of the above polymers, preferable for use in the present invention are a homopolymer, a random copolymer, a block copolymer and a graft copolymer of an $\alpha$, $\beta$-unsaturated acid. Particularly preferable is a copolymer of an alkyl vinyl ether and maleic anhydride.

The present inventor conducted extensive research on mixtures of a basic polymer and an acidic polymer, both such as mentioned above and found that when these two polymers are mixed in a solution, they interact each other in an unclarified way, forming a polymer complex different from any of them and, when the two polymers are mixed in a relatively poor solvent, a polymer complex is precipitated and, when they are mixed in a relatively good solvent, the mixture shows properties different from those of a mere mixture of the two polymers with a remarkably increased viscosity.

The polymer complex used in the present invention refers to a polymer complex comprising an acidic polymer and a basic polymer, both mentioned above. A preferable polymer complex for use in the present invention is the one obtained by mixing the two polymers in such a proportion as their basicity and acidity match approximately. The mixing proportion can be determined by their basicity and acidity. A polymer complex formed by mixing the two polymers in an appropriate proportion is not well dyed with an acidic dye or a basic dye. Hence, this fact can be employed for determination of a mixing ratio of the two polymers.

The polymer complex obtained as above is generally insoluble in relatively poor solvents such as water, alcohols, esters, hydrocarbons and the like. Therefore, in production of a polymer complex, each starting polymer is dissolved in a poor solvent; the resulting two solutions are mixed; and the resulting polymer complex precipitate can be isolated. Alternatively, the two polymers are mixed in a relatively good solvent such as dimethylformamide, dimethylacetamide dimethylsulfoxide or the like, whereby a polymer complex can be obtained in a solution form. Hence, in forming a photosensitive layer comprising such a polymer complex on the recording layer, there can be used, for example, (1) a method wherein two solutions each containing a different (basic or acidic) polymer are prepared, one solution is coated on the recording layer provided on the base plate, the other solution is coated thereon in a predetermined amount to form a polymer complex on the recording layer, or (2) a method wherein a basic polymer and an acidic polymer are dissolved in a relatively good solvent to prepare a polymer complex solution and this solution is coated on the recording layer.

In formation of a photosensitive layer made from a polymer complex, the photosensitive layer needs to contain an appropriate amount (e.g. about 0.1 to 10 parts by weight based on 100 parts by weight of the polymer complex) of a known photosensitive material (a sensitizing agent) to allow the photosensitive layer to have photosensitivity. Such a sensitizing agent includes known compounds such as an organic photochromic compound (e.g. a spiropyran type compound, an anthrone type compound, a triphenylmethane type compound), a photosensitive aromatic diazonium salt compound (a diazonium double salt soluble in organic solvents is particularly preferable), an aromatic azide compound, a polyhalogenated compound and any other photodegradable compound. Specific examples of these compounds are disclosed in, for example, Japanese Patent Publication No. 42744/1980.

The image recording material of the present invention is prepared from the above mentioned materials. In the present invention, materials other than those mentioned above can be used. For example, a thermoplastic polymer other than those mentioned above can be used in combination with a polymer complex as mentioned above to enhance the film-forming ability. Also, a small amount of a coloring agent can be incorporated into the recording layer to allow the layer to have a light color.

Figure 2:
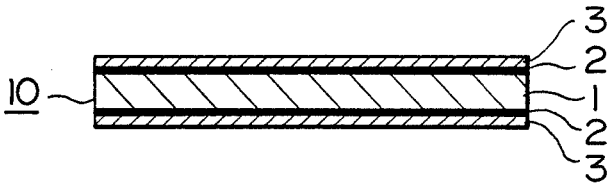

The present invention will be described in further detail by referring to the accompanying drawings illustrating the constitution of the image recording material of the present invention. FIG. 1 is a sectional view of one embodiment of the image recording material 10 of the present invention. 1 denotes an electroconductive base plate. 2 a recording layer, and 3 a photosensitive layer comprising a polymer complex and a sensitizing agent. FIG. 2 is a sectional view of another embodiment of the image recording material of the present invention.

As shown in FIGS. 1 and 2, the image recording material 10 of the present invention comprises an electroconductive base plate 1, a recording layer 2 comprising an electrolytically polymerized film provided on at least one side of said base plate and a photosensitive layer 3 comprising a polymer complex and a sensitizing agent provided on said recording layer. In the image recording material 10 of FIG. 2, a recording layer 2 and a photosensitive layer 3 are provided in this order on each side of an electroconductive base plate 1. When a recording layer 2 and a photosensitive layer 3 are provided in this order only on one side of an electroconductive base plate 1, it is preferable that an insulating film of a desired thickness (not shown) be provided on the other side of the base plate. However, it is not necessary when the base plate is electroconductive only at one side (the side on which the recording layer is provided) as seen in, for example, an indium-titanium oxide deposited glass and an aluminum deposited film.

The electroconductive base plate 1 can have any thickness and any shape from a technical standpoint. However, it is generally preferable that the base plate be in a shape of a plate, a sheet or a film having a thickness of about 0.03 to 3 mm. The shape can be any including a tape as long as it meets the application purposes of the image recording material. The recording layer 2 can have the same shape as the base plate 1 or can have a smaller area than the latter. Its thickness is generally preferred to be about 0.1 to 10 μm. The photosensitive layer 3 can be formed according to one-solution method or two-solution method both mentioned previously. Its thickness is generally preferred to be about 0.1 to 10 μm.

The present inventor found that the image recording material of the present invention, despite the electroconductivity of the base plate 1 and the recording layer 2, is a poor conductor as a whole. This could have been predicted naturally from the fact that the two polymers constituting the polymer complex of the photosensitive layer 3 neutralize with each other. Further research by the present inventor revealed that when this photosensitive layer is exposed to a pattern of actinic rays having an energy larger than that of the surrounding atmosphere, only the exposed portions of the photosensitive layer become electroconductive, in other words, a latent image is formed by these electroconductive portions and that the latent image retains the electroconductivity for several minutes to several days even after the termination of the exposure to the actinic ray pattern and returns to the original insulating property after that period.

Figure 3:
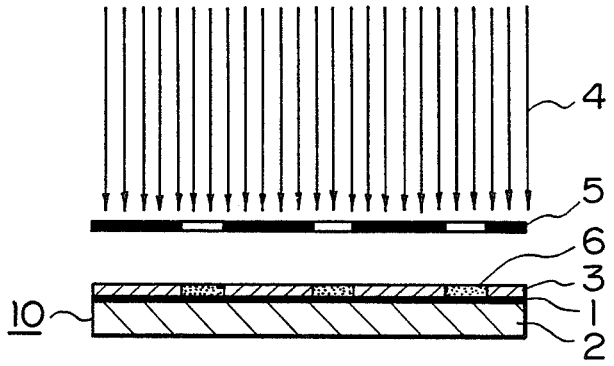
FIG. 3 illustrates a method for subjecting an image recording material of the present invention to light exposure using a pattern of actinic rays.

Various known methods can be used for exposing the image recording material of the present invention to a pattern of actinic rays to record information therein and to form a latent image. There can be used, for example, a method as illustrated in FIG. 3 wherein a light 4 is utilized as a recording means and a transparent original image pattern 5 is superimposed on an image recording material 10, or a method (not shown) wherein an original pattern is imaged on the photosensitive layer of an image recording material through a lens system. As the actinic rays, there can be utilized ultraviolet rays, a visible light, infrared rays, their laser beams, electron beams, etc.

Information recording in the image recording material of the present invention can also be conducted by exposing the recording material to a thermal pattern. This type of recording can be conducted by various methods such as (1) a mechanical method wherein the photosensitive (heat-sensitive) layer of an image recording material is heated locally and selectively by scanning with a thermal energy 4 of, for example, a thermal stylus, a thermal typewriter, a thermal printing head, laser beams or electron beams and (2) a radiant heating method wherein an original letter pattern having radiation absorptivity and an image recording material are superimposed in such a way that heat conduction takes place between them and a strong radiation is applied to them using an incandescent tungsten lamp or any other appropriate means.

A latent image 6 is formed in the photosensitive layer of the image recording material of the present invention in a manner as mentioned above. The image recording material is then subjected to development according to the following method to convert the latent image to a visible image. This development method is one of the important features of the present invention.

Figure 4:
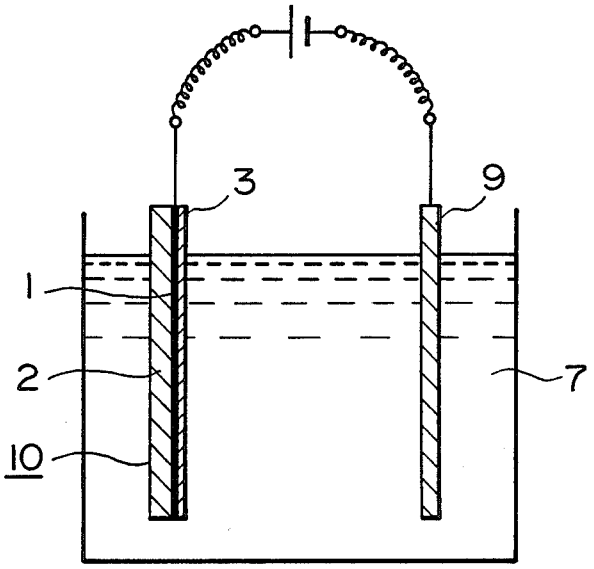
FIG. 4 illustrates a method for subjecting an image recording material of the present invention to electrochemical development.
Figure 5:
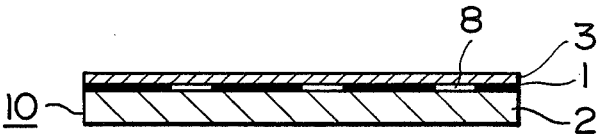
FIG. 5 illustrates an image recording material of the present invention having been subjected to development.

The development method for latent images is explained specifically by referring to the accompanying drawings. FIG. 4 illustrates a method for subjecting to development a latent image 6 formed in the image recording material of the present invention. FIG. 5 illustrates schematically a section of the image recording material 10 after development treatment.

In a preferred development as shown in FIGS. 4 and 5, an image recording material 10 wherein a latent image has been formed in the photosensitive layer is immersed in an electrolytic solution 7 as an anode and an electric current is allowed to flow between the two electrodes through the solution. Since only the latent image portions of the photosensitive layer are electroconductive, the portions of the recording layer corresponding to said portions of the photosensitive layer become colorless, as a result of the flow of an electric current, due to an electrochemical action. This mechanism is not clear, but it is considered that anodic oxidation brought about by the flow of an electric current causes oxidation and cleavage of conjugated double bonds in the electrolytically polymerized film of the recording layer, whereby the decoloring takes place. When an anionic coloring substance is contained in the electrically polymerized film, the coloring substance is considered to be oxidized and decomposed as well and to lose its color. In this way there is formed a negative pattern of high color contrast in the recording layer. As a matter of course, a positive pattern is formed by exposing the non-image portions of the photosensitive layer to an original pattern of actinic rays and then subjecting the image recording material to development as mentioned above.

The electrolytic solution 7 and the cathode used in the above development treatment can be respectively the same as those used in electrolytic polymerization, and the development conditions can be the same as those for electrolytic polymerization.

As described in detail above, the image recording material of the present invention comprises an electroconductive base plate, a recording layer comprising an electrolytically polymerized film provided on said base plate and a photosensitive layer of a particular photosensitive polymer complex provided on said recording layer. The recording layer and the photosensitive layer do not lose photosensitivity when left standing under ordinary circumstances. No special care is required for formation of these two layers under ordinary circumstances, making their commercial production advantageous. The latent image formed in the photosensitive layer can be converted by development into a visible image having a high color contrast, very easily, that is, simply by an electrolytic treatment. In the photosensitive layer after development, the latent image portions and the non-image portions return to their original state of a stable polymer complex with the lapse of time. As a result, the photosensitive layer after development does not undergo any change due to surrounding conditions, so that the information stored in the recording layer can be remarkably stable in storage.

The present invention will be described more specifically by way of Examples. Parts and % in the following refer to parts by weight and % by weight, respectively.

EXAMPLE 1

0.1 M of pyrrole and 0.1 M of sodium p-toluenesulfonate were dissolved in water to obtain an electrolytically polymerizable solution. In the solution were placed an ITO (indium-titanium oxide) glass plate of 10 cm × 10 cm having a resistance of 20 Ω as an anode and a nickel plate as a cathode. Electrolysis was conducted for 50 seconds applying a DC voltage of 3 V to form on the anode a greenish brown, electroconductive polypyrrole film having a thickness of about 1 μm.

Polyvinylpyrrolidone (K=90): 5 parts

Methyl vinyl ether/maleic anhydride - monobutyl ester copolymer ( Gantrez ES-425, 50% ethanol solution, manufactured by GAF Co.): 10 parts p-N, N'-dimethylaminobenzene - diazonium tetrafluoroborate: 0.5 part Ethanol: 100 parts Dimethylformamide: 100 parts The above solution was uniformly coated on the polypyrrole film prepared above, using a Meyer bar (#32) and dried at 100° C. for 5 minutes to form a photosensitive layer having a thickness of 3 μm. Thus, an image recording material according to the present invention was obtained.

A negative pattern made from a silver salt was allowed to tightly adhere to the image recording material. A light emitted by a high pressure mercury lamp of 400 W was irradiated to it for 3 seconds from the side of the pattern with the distance between lamp and pattern kept at 10 cm.

Then, the image recording material was connected to the anode of a DC source and a nickel plate was connected to the cathode. The recording material and the nickel plate were placed in an electrolytic solution (100 parts of distilled water containing 0.1 M of sodium p-toluenesulfonate) and constant voltage (4 V) electrolysis was conducted for 10 seconds, whereby the portions of the recording layer of the recording material corresponding to the exposed portions of the photosensitive layer lost its original color to be colorless and a negative pattern image was formed with the background portions retaining an original greenish brown color. The image had a high color contrast and the recording material after development could well be used as a slide. The image had very good storage stability. The adhesion among the base plate, the recording layer and the photosensitive layer was satisfactory.

EXAMPLE 2

An image recording material of the present invention was prepared in the same manner as in Example 1, except that p-N,N'-dimethylaminobenzene diazonium tetrafluoproborate used in the polymer solution for photosensitive layer of Example 1 was replaced by 6'-nitrospiropyran, and the photosensitive layer was prepared by coating on the polypyrrole film to give image recording material having a thickness of 2 μm. This recording material was subjected to the same pattern exposure as in Example 1 using the same high pressure mercury lamp for 5 seconds. Then, the recording material was connected to the anode of a DC source and a nickel plate was connected to the cathode, and they were placed in an electrolytic solution (100 parts of water containing 0.1 M of sodium p-toluenesulfonate). Constant voltage (4 V) electrolysis was conducted for 10 seconds, whereby the portions of the recording layer corresponding to the exposed portions of the photosensitive layer became colorless and a colorless and transparent negative pattern of high color contrast was obtained with the background portions retaining an original greenish brown color.

EXAMPLE 3

0.1 M of pyrrole and 0.1 M of sodium p-toluenesulfonate were dissolved in water to use as an electrolytically polymerizable solution. In the solution were placed an ITO glass plate of 10 cm×10 cm having a resistance of 20 Ω as an anode and a nickel plate as a cathode. Electrolysis was conducted for 50 seconds applying a DC voltage of 3 V to form on the anode a greenish brown, electroconductive polypyrrole film having a thickness of about 1 μm.

The following polymer solution was coated on the polypyrrole in accordance with a spinner coating method so that the coated film had a thickness of 3 μm (as dried). The film was dried to obtain a photosensitive (heat-sensitive) layer. Thus, an image recording material of the present invention was obtained.

Polyvinylpyrrolidone (K=90): 5 parts

Poly(methyl vinyl ether)/maleic anhydridemonobutyl ester copolymer ( Gantrez ES-425, 50% ethanol solution, manufactured by GAF Co.): 10 parts Ethanol: 100 parts Dimethylformamide: 100 parts Argon laser beams having a wavelength of 514 nm and a power of 10 mW were applied to the image recording material obtained above, for 1 microsecond from the side of the heat-sensitive layer to conduct bit recording.

Then, the resulting recording material was connected to the anode of a DC source and a nickel plate was connected to the cathode, and they were placed in an aqueous solution containing 1% of sodium p-toluenesulfonate. A DC voltage of 3 V was applied between them for 3 seconds, whereby only the portions of the recording material exposed to laser beams turned from brown to colorless and transparent and a negative pattern was formed. This image can be read out as a signal having a large intensity ratio of transmitted light.

EXAMPLE 4

An image recording material was prepared in the entirely same manner as in Example 3. The non-image portions of this recording material were exposed to argon laser beams in the same manner as in Example 3. The resulting recording material was connected to the anode of a DC source and a nickel plate was connected to the cathode, and they were placed in an aqueous solution containing 0.1 M of sodium p-toluenesulfonate. A DC voltage of 4 V was applied between them for 10 seconds, whereby the exposed portions had a brown color and the non-exposed portions turned colorless and a positive pattern was obtained. This image had a satisfactory color contrast and the recording material after development was usable as a slide, a mask, an optical disk, etc.

We claim:

1. An image forming material comprising in sequence:

(a) an electrconductive base plate;

(b) a recording layer comprising an electrolytically polymerized film; and (c) a photosenstiive layer comprising a polymer complex formed of an acidic polymer and a basic polymer.

2. The image-forming material according to claim 1, wherein the base plate is selected from the group consisting of (i) a metal base plate formed of gold, platinum, silver, nickel or copper; (ii) a plate formed by vapor depositing on a glass plate or a resin film, an oxide of gold, platinum, silver, nickel, copper, tin, indium or indium-tin.

3. An image forming material according to claim 1, wherein the base plate has a thickness of 0.03 to 3 mm.

4. An image forming material according to claim 1, wherein the recording layer has a thickness of 0.1 to 10 μm.

5. An image forming material according to claim 1, wherein the photosensitive layer has a thickness of 0.1 to 10 μm.

6. An image-forming material comprising, in sequence:

(a) an electroconductive base plate;

(b) a recording layer comprising an electrolytically polymerized film formed from a monomer selected from the group consisting of pyrrole, thiophene, furan, selenophene, tellurophene, indole, azurene, aniline, thienothiophene, pyrrolopyrrole and diacetylene;

(c) a photosensitive layer comprising a polymer complex formed of an acidic polymer and a basic polymer.

7. The image-forming material according to claim 6, wherein the base plate is selected from the group consisting of (i) a metal base plate formed of gold, platinum, silver, nickel or copper; (ii) a plate formed by vapor depositing on a glass plate or a resin film, an oxide of gold, platinum, silver, nickel, copper, tin, indium or indium-tin.

8. An image forming material according to claim 6, wherein the base plate has a thickness of 0.03 to 3 mm.

9. An image forming material according to claim 6, wherein the recording layer has a thickness of 0.1 to 10 μm.

10. An image forming material according to claim 6, wherein the photosensitive layer has a thickness of 0.1 to 10 μm.

11. An image forming material comprising in sequence:

(a) an electroconductive base plate;

(b) a recording layer comprising an electrolytically polymerized film; and (c) a photosensitive layer comprising a polymer complex formed of an acidic polymer and a basic polymer, wherein the recording layer and the photosensitive layer are formed on each side of the electroconductive base plate.

12. The image-forming material according to claim 11, wherein the base plate is selected from the group consisting of (i) a metal base plate formed of gold, platinum, silver, nickel or copper; (ii) a plate formed by vapor depositing on a glass plate or a resin film, an oxide of gold, platinum, silver, nickel, copper, tin, indium or indium-tin.

13. An image forming material according to claim 11, wherein the base plate has a thickness of 0.03 to 3 mm.

14. An image forming material according to claim 11, wherein the electrolytically polymerized film is produced from a monomer selected from pyrrole, thiophene, furan, selenophene, tellurophene, indole, azulene, aniline, thienothiophene, pyrrolopyrrole and diacetylene.

15. An image forming material according to claim 11, wherein the recording layer has a thickness of 0.1 to 10 μm.

16. An image forming material according to claim 11, wherein the photosensitive layer has a thickness of 0.1 to 10 μm.

17. An image forming material according to claim 11, wherein the photosensitive layer further contains a sensitizing agent.

18. An image recording material according to claim 17, wherein the content of the sensitizing agent in the photosensitive layer is 0.1 to 10 parts by weight per 100 parts by weight of the polymer complex.

19. An image recording material according to claim 17, wherein the sensitizing agent is selected from an organic photochromic material, a photosensitive aromatic diazonium salt compound, an aromatic azide compound, a polyhalogenated compound and a photodecomposable compound.

* * * * *

UNITED STATES PATENT AND TRADEMARK OFFICE

CERTIFICATE OF CORRECTION

PATENT NO. : 4,711,830

DATED : December 8, 1987

INVENTOR(S) : MASAHIRO HARUTA, ET AL.

It is certified that error appears in the above-identified patent and that said Letters Patent is hereby corrected as shown below: On the Title Page:

AT [57] IN THE ABSTRACT

Line 5, "may constituted" should read --may be constituted--.
Line 5, "a" should read --an--.
Line 6, "may" should read --may be--.

COLUMN 3

Line 31, "above mentioned" should read --above-mentioned--.
Line 68, "has" should be deleted.

COLUMN 4

Line 12, "and" should be deleted.

COLUMN 5

Line 35, "act each" should read --act with each--.

COLUMN 6

Line 26, "above mentioned" should read --above-mentioned--.
Line 40, "plate. 2" should read --plate, 2--.

COLUMN 9

Line 45, "tetrafluoproborate" should read --tetrafluoroborate--.

UNITED STATES PATENT AND TRADEMARK OFFICE

CERTIFICATE OF CORRECTION

PATENT NO. : 4,711,830

DATED : December 8, 1987

INVENTOR(S) : MASAHIRO HARUTA, ET AL.

It is certified that error appears in the above-identified patent and that said Letters Patent is hereby corrected as shown below:

COLUMN 10

Line 14, "anhydridemonobutyl" should read --anhydride-monobutyl--.

COLUMN 10

Line 54, "electrconductive" should read --electroconductive--.
Line 57, "photosenstiive" should read --photosensitive--.

COLUMN 11

Line 14, "azurene," should read --azulene,--.
Line 16, "tylene;" should read --tylene; and--.

Signed and Sealed this

Seventeenth Day of May, 1988

*Attest:*

*Attesting Officer*

DONALD J. QUIGG

*Commissioner of Patents and Trademarks*